US011248401B2

(12) United States Patent
Laroche et al.

(10) Patent No.: US 11,248,401 B2
(45) Date of Patent: Feb. 15, 2022

(54) DOOR FOR A VEHICLE

(71) Applicant: BOMBARDIER RECREATIONAL PRODUCTS INC., Valcourt (CA)

(72) Inventors: David Laroche, Sherbrooke (CA); Dave Proulx, Sherbrooke (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 110 days.

(21) Appl. No.: 16/495,909

(22) PCT Filed: Sep. 14, 2017

(86) PCT No.: PCT/IB2017/055580

§ 371 (c)(1),
(2) Date: Sep. 20, 2019

(87) PCT Pub. No.: WO2018/172834

PCT Pub. Date: Sep. 27, 2018

(65) Prior Publication Data

US 2020/0048938 A1 Feb. 13, 2020

Related U.S. Application Data

(60) Provisional application No. 62/473,613, filed on Mar. 20, 2017.

(51) Int. Cl.

| | |
|---|---|
| ***E05B 85/10*** | (2014.01) |
| ***E05B 79/06*** | (2014.01) |
| ***E05B 3/02*** | (2006.01) |

(52) U.S. Cl.

CPC ..... *E05B 79/06* (2013.01); *E05B 3/02* (2013.01); *E05B 85/10* (2013.01); *Y10T 292/57* (2015.04);

(Continued)

(58) Field of Classification Search

CPC . E05B 3/02; E05B 85/10; E05B 79/06; Y10T 292/57; Y10T 292/82; Y10T 292/85; Y10T 292/93

See application file for complete search history.

(56) References Cited

U.S. PATENT DOCUMENTS 1,580,666 A * 4/1926 Hansen ..... E05B 65/0811 292/128
2,498,527 A 2/1950 Castle (Continued)

FOREIGN PATENT DOCUMENTS

DE 661660 C * 6/1938 ..... E05C 9/06
IN 2011DE00120 A 8/2013

(Continued)

OTHER PUBLICATIONS

International Search Report of PCT/IB2017/055580; Blaine R. Copenheaver; dated Jan. 29, 2018.

(Continued)

*Primary Examiner* — Carlos Lugo
(74) *Attorney, Agent, or Firm* — BCF LLP

(57) ABSTRACT

A door and a vehicle including the door. The door includes a door body; a latch movable between locked and unlocked positions; a first handle accessible from an exterior side of the body; a second handle accessible from an interior side of the body; and a rod connecting the latch and the handles, the handles rotating about a common axis, the first handle being rotatable between a first and a second position, the second handle being rotatable between a third and a fourth position, the latch being in the locked position when the first handle is in the first position and the second handle is in the third position, the latch being in the unlocked position when the (Continued)

first handle is in the second position, the latch being in the unlocked position also when the second handle is in the fourth position.

19 Claims, 16 Drawing Sheets

(52) U.S. Cl.
CPC ..... *Y10T 292/82* (2015.04); *Y10T 292/85* (2015.04); *Y10T 292/93* (2015.04)

(56) References Cited

U.S. PATENT DOCUMENTS 2,580,584 A * 1/1952 Nowak ..... E05B 65/0021 292/36
3,785,687 A * 1/1974 Yulkowski ..... E05B 1/0007 292/347
4,471,984 A * 9/1984 Bellantuono ..... E05B 3/04 292/350
4,569,547 A 2/1986 Fayerman et al.
4,641,865 A * 2/1987 Pastva ..... E05B 63/0069 292/5
4,783,103 A 11/1988 Schlegel
6,095,573 A * 8/2000 Rozema ..... E05B 5/003 292/336.3
6,264,257 B1 7/2001 Meinke
6,471,260 B1 10/2002 Weinerman et al.
7,040,675 B1 5/2006 Ott et al.
7,343,762 B1 * 3/2008 East ..... E05B 13/108 292/36
8,998,275 B2 * 4/2015 Donaldson ..... F41H 5/226 292/216
10,337,218 B2 * 7/2019 Do ..... E05C 5/02
10,526,820 B2 * 1/2020 Schroeder ..... E05B 83/04
2005/0200253 A1 9/2005 Wissinger et al.

FOREIGN PATENT DOCUMENTS

JP 5125862 A 5/1993
WO 2014195928 A1 12/2014

OTHER PUBLICATIONS

English Translation of JP5125862 accompanying the International Search Report of PCT/IB2017/055580 received from the ISA/US. Written Opinion from the IPEA/US; Kristina Fulton; dated Jul. 12, 2019.

* cited by examiner

DOOR FOR A VEHICLE

CROSS-REFERENCE

The present application claims priority to U.S. Provisional Patent Application No. 62/473,613, filed Mar. 20, 2017, entitled "Door for a Vehicle," the entirety of which is incorporated herein by reference.

FIELD OF TECHNOLOGY

The present technology relates to doors with handles for vehicles.

BACKGROUND

Side-by-side vehicles (SSVs) are four-wheeled vehicles designed for off-road use. They have a driver seat and a passenger seat disposed side-by-side inside a passenger area defined in part by a roll cage. Some SSVs have doors to selectively and partially close the passenger area.

As is known in the art, four-wheeled vehicles, such as automobiles, often have doors with both interior and exterior handles to allow vehicle operators to open the doors from an interior of the vehicle and an exterior of the vehicle. This generally requires two mechanisms, one for each of the interior and exterior handles, in order to operate the single latch holding the door shut.

In some implementations of SSVs and other vehicles with half doors, doors are provided with only one handle per door to reduce the weight, complexity, and cost of the doors compared to doors having two handles and two mechanisms. The single handle is generally on an interior side of the door and the vehicle operator then opens the door from the exterior by reaching over the door into the interior of the vehicle and operating the interior handle.

While there is an overall reduction in weight and cost by using only a single handle, this solution creates a recurring inconvenience for operators, who must lean into the vehicle and operate an interior handle from the exterior of the vehicle. This solution is further not applicable to SSVs where the operator cannot easily reach into the vehicle, for example when a netting is installed from the door to the roll cage of the SSV.

There is therefore a desire for a door for a vehicle which improves user convenience while also addressing the weight, complexity, and cost considerations mentioned above.

SUMMARY

It is an object of the present technology to ameliorate at least some of the inconveniences present in the prior art.

According to one aspect of the present technology, there is provided a door for a vehicle and vehicle having such doors. The door is provided with an interior handle and an exterior handle, the two handles sharing a single locking mechanism for operating a latch of the door. As such, the door has two handles while addressing the complexity, weight and/or cost considerations for the door and the vehicle having the door according to the present technology. The inclusion of two handles increases convenience for the operator, while having a single locking mechanism decreases the complexity, weight, and cost of the door. Specifically, the two handles share a common rotation axis, where rotation of either one of the handles about that axis causes a rod to operate a latch.

According to one aspect of the present technology, there is provided a door for a vehicle. The door includes a door body; a latch connected to the door body, the latch being selectively movable between a locked position and an unlocked position; a first handle rotatably connected to the door body, the first handle being accessible from an exterior side of the door body; a second handle rotatably connected to the door body, the second handle being accessible from an interior side of the door body; and a rod connected between the latch and at least one of the first handle and the second handle, the first handle and the second handle rotating about a common rotation axis, the first handle being rotatable between a first position and a second position, the second handle being rotatable between a third position and a fourth position, the latch being in the locked position when the first handle is in the first position and the second handle is in the third position, the latch being in the unlocked position when the first handle is in the second position and the second handle is in any position, the latch being in the unlocked position also when the second handle is in the fourth position and the first handle is in any position, when the door is pivotably mounted to the vehicle: the locked position of the latch preventing the door from pivoting with respect to the vehicle when the door is in a closed position, the unlocked position of the latch allowing the door to pivot with respect to the vehicle.

In some implementations of the present technology, the first handle is operatively connected to the second handle such that rotation of one of the first handle and the second handle causes an other one of the first handle and the second handle to rotate; the first handle is in the first position when the second handle is in the third position; and the first handle is in the second position when the second handle is in the fourth position.

In some implementations of the present technology, the first handle and the second handle have a fixed relative orientation to each other such that rotation of the one of the first and second handles causes an equal rotation of the other one of the first and second handles.

In some implementations of the present technology, at least one of the first handle and the second handle includes a protrusion; at least an other one of the first handle and the second handle defines a recess; and the first handle and the second handle are connected together by the protrusion being received in the recess.

In some implementations of the present technology, the first handle and the second handle rotate in a same direction about the rotation axis.

In some implementations of the present technology, the latch is disposed in a rear portion of the door; and the door further includes at least one hinge connected to a front portion of the door for pivotably connecting the door to the vehicle.

In some implementations of the present technology, the first handle is biased toward the first position and the second handle is biased toward the third position.

In some implementations of the present technology, the door further includes a biasing element operatively connected to at least one of the first handle and the second handle.

In some implementations of the present technology, the biasing element is a leaf spring.

In some implementations of the present technology, the door further includes a shaft connected the door body; and the first handle and the second handle are rotatably disposed on the shaft.

In some implementations of the present technology, a lever portion of the first handle extends away from the rotation axis in a first direction; and a lever portion of the second handle extends away from the rotation axis in a second direction, the second direction being opposite the first direction.

In some implementations of the present technology, the latch is biased toward the unlocked position.

In some implementations of the present technology, the door body includes a door frame, and at least one door panel; the at least one door panel defining at least one aperture through which extends at least one of the first handle, the second handle, and the shaft; and the first handle and the second handle are rotatably connected to the door frame.

According to another implementation of the present technology, there is provided a vehicle including a frame; two front wheels operatively connected to the frame; two rear wheels operatively connected to the frame; at least one seat connected to the frame; a motor connected to the frame, the motor being operatively connected to at least one of the two front wheels; and the two rear wheels; and at least one door connected to the frame. The at least one door includes a door body; a latch connected to the door body, the latch being selectively movable between a locked position and an unlocked position; a first handle rotatably connected to the door body, the first handle being located on an exterior side of the vehicle; a second handle rotatably connected to the door body, the second handle being located on an interior of the vehicle; and a rod connected between the latch and at least one of the first handle and the second handle, the first handle and the second handle rotating about a common rotation axis, the first handle being rotatable between a first position and a second position, the second handle being rotatable between a third position and a fourth position, the latch being in the locked position when the first handle is in the first position and the second handle is in the third position, the latch being in the unlocked position when the first handle is in the second position and the second handle is in any position, the latch being in the unlocked position also when the second handle is in the fourth position and the first handle is in any position, the locked position of the latch preventing the at least one door from pivoting with respect to the vehicle when the door is in a closed position, the unlocked position of the latch allowing the at least one door to pivot with respect to the vehicle.

In some implementations of the present technology, the first handle is operatively connected to the second handle such that rotation of one of the first handle and the second handle causes an other one of the first handle and the second handle to rotate; the first handle is in the first position when the second handle is in the third position; and the first handle is in the second position when the second handle is in the fourth position.

In some implementations of the present technology, the first handle and the second handle have a fixed relative orientation to each other such that rotation of the one of the first and second handles causes an equal rotation of the other one of the first and second handles.

In some implementations of the present technology, the latch is disposed in a rear portion of the at least one door; the at least one door further includes at least one hinge connected to a front portion of the at least one door; and the at least one hinge pivotably connects the at least one door to the vehicle.

In some implementations of the present technology, the at least one door further includes a biasing element operatively connected to at least one of the first handle and the second handle; and the biasing element biases the first handle toward the first position and the second handle toward the third position.

In some implementations of the present technology, the at least one door further includes a shaft connected the door body; and the first handle and the second handle are rotatably disposed on the shaft.

In some implementations of the present technology, the vehicle further includes a striker connected to the frame, the latch being fastened to the striker when the door is in the closed position and the latch is in the locked position.

For the purposes of the present application, terms related to spatial orientation such as forward, rearward, front, rear, upper, lower, left, and right, are as they would normally be understood by a driver of the vehicle sitting therein in a normal driving position with the vehicle being upright and steered in a straight ahead direction.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

It should also be noted that, unless otherwise explicitly specified herein, the drawings are not necessarily to scale.

DETAILED DESCRIPTION

The present technology will be described herein with respect to side-by-side vehicles. It is contemplated that aspects of the present technology could also be applied to other types of vehicles having doors, such as automobiles.

Figure 1:
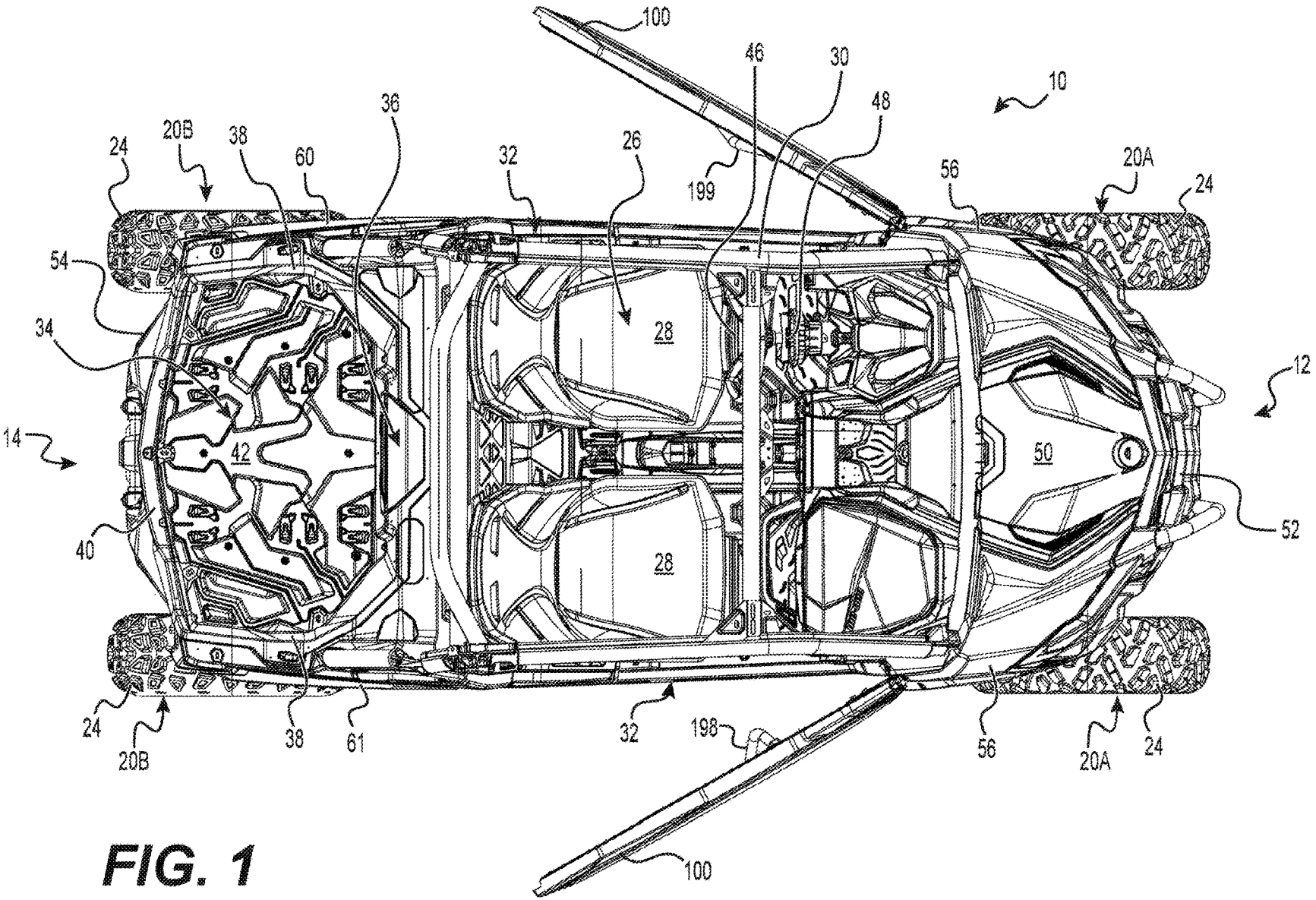
FIG. 1 is a top plan view of a side-by-side vehicle, with doors of the vehicle being opened.
Figure 2:
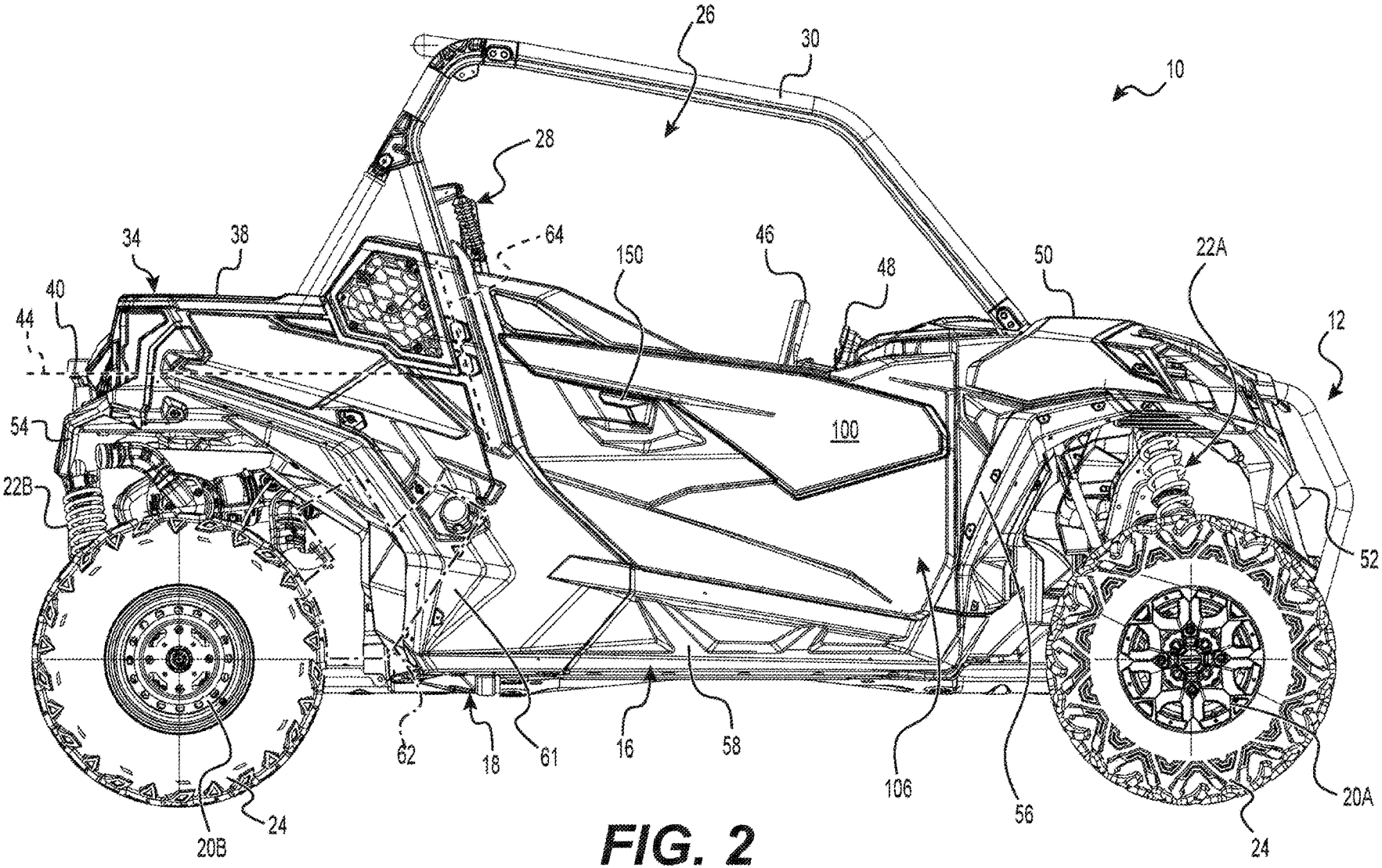
FIG. 2 is a right side elevation view of the vehicle of FIG. 1 with doors of the vehicle being closed.
Figure 3:
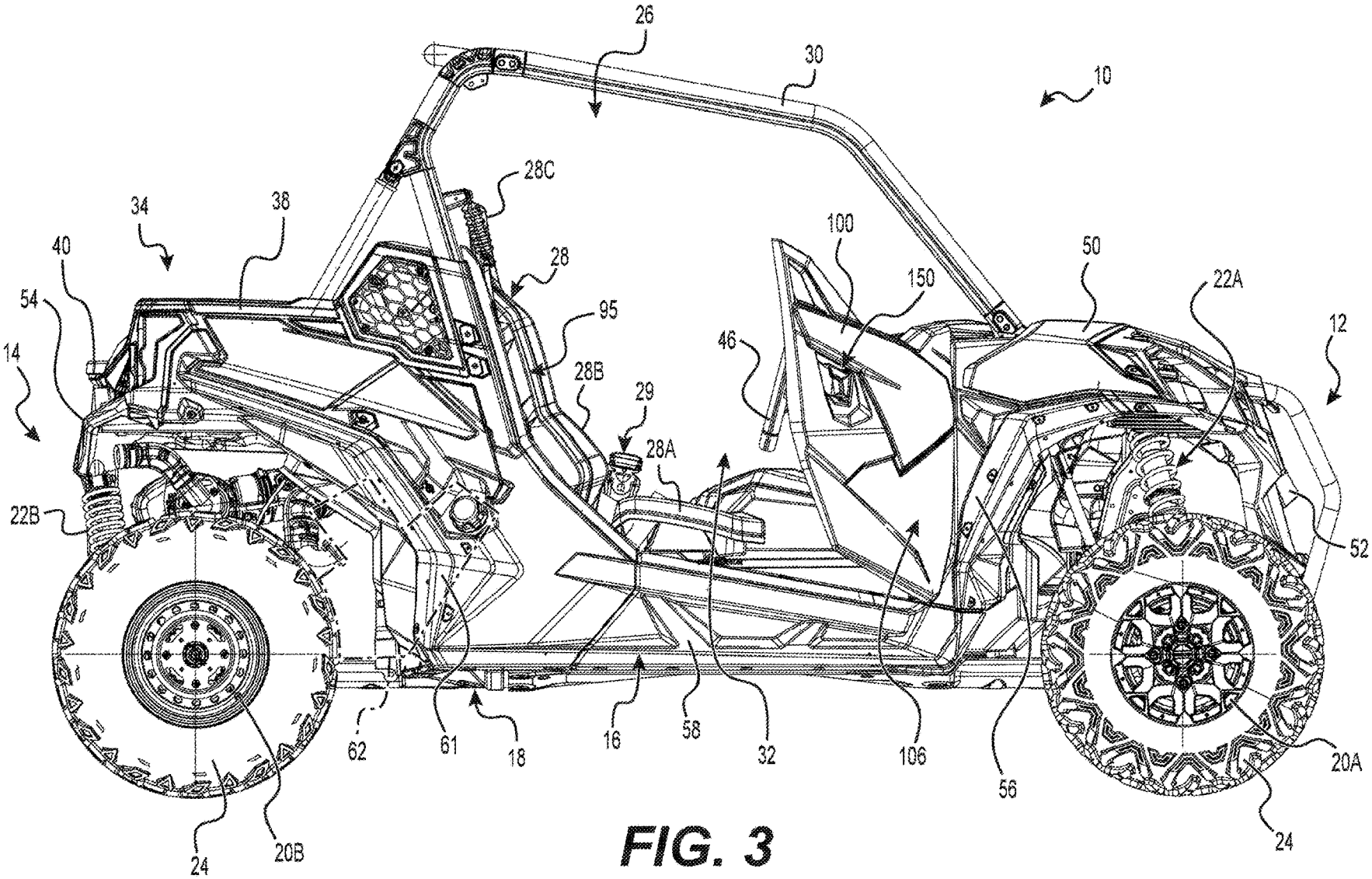
FIG. 3 is a right side elevation view of the vehicle of FIG. 1, with doors of the vehicle being open.

A side-by-side vehicle (SSV) 10 is illustrated in FIGS. 1 to 3. The SSV 10 has a front end 12, a rear end 14, and two lateral sides 16 (left and right). The SSV 10 includes a frame 18. A pair of front wheels 20A is suspended from the front portion of the frame 18 via front suspension assemblies 22A. A pair of rear wheels 20B is suspended from the rear portion of the frame 18 via rear suspension assemblies 22B. Each of the four wheels 20A, 20B has a tire 24. A cockpit area 26 is disposed in the middle portion of the frame 18. Left and right seats 28 are connected to the middle portion of the frame 18. As can be seen in FIG. 1, the seats 28 are disposed side-by-side in the cockpit area 26. Each seat 28 is a bucket seat having a seat base 28A and a backrest 28B. Each backrest 28B incorporates a headrest 28C. It is contemplated that the seats 28 could be other types of recumbent seats. Each seat 28 is also provided with a seat belt 29.

A roll cage 30 is connected to the frame 18 and is disposed above the cockpit area 26. The roll cage 30 is an arrangement of metal tubes that contributes to protecting the riders. The roll cage 30 has several attachment points to the frame 18. The cockpit area 26 forms two lateral passages 32 (left and right) on the two lateral sides 16 of the SSV 10. The two lateral passages 32 are selectively partially closed by two doors 100. The doors 100 are pivotably mounted to the vehicle 10 and are pivotable between a closed position (shown in FIG. 2) and various open positions (shown in FIGS. 1 and 3). The riders can ingress and egress the SSV 10 when the doors 100 are opened. The doors 100 will be described in more detail below.

A cargo box 34 is mounted to the frame 18 rearward of the seats 28. It is contemplated that the cargo box 34 could be replaced by a cargo rack. In the present implementation, the carbo box 34 is fixed to the frame 18, but it is also contemplated that the cargo box 34 could be pivotally mounted to the frame 18. It is contemplated that in some implementations, the cargo box 34 could be omitted. The cargo box 34 has a front wall 36, two side walls 38, a rear wall 40 and a floor 42. As seen in FIGS. 2 and 3, the rear wall 40 is lower than the side walls 38, thus facilitating access to the cargo space defined by the cargo box 34. The vertical level of the floor 42 is indicated by line 44 in FIG. 2.

A steering device including a steering wheel 46 is disposed in front of the left seat 28. It is contemplated that the steering wheel 46 could be disposed in front of the right seat 28. The steering device is operatively connected to the two front wheels 20A to permit steering of the SSV 10. A display cluster 48 is disposed in front of the steering wheel 46. A throttle operator in the form of a throttle pedal (not shown) is disposed over the floor of the cockpit area 26 below the steering wheel 46 and in front of the left seat 28.

The SSV 10 has a vehicle body mounted to the frame 18. The vehicle body includes a hood 50, a front body panel 52, a rear body panel 54 and a number of side body panels. The side body panels include front right and left fenders 56, lower central right and left panels 58, a rear left fender 60 and a rear right fender 61. It is contemplated that the hood 50, the front body panel 52, the rear body panel 54, the fenders 56, 60, 61, and the lower central panels 58 could each be replaced by multiple panels. It is also contemplated that the vehicle body of the SSV 10 could have more or less body panels than described above.

The SSV 10 is powered by a motor, specifically an internal combustion engine 62, which is shown schematically in FIG. 2. The engine 62 is disposed rearward of the seat bases 28A below the cargo box 34. Shown schematically in FIG. 2, a firewall 64 is disposed between the seats 28 and the engine 62. It is contemplated that the engine 62 could be replaced by a hybrid or electric motor in some implementations. The engine 62 is operatively connected to the wheels 20A, 20B to drive the wheels 20A, 20B in order to drive the SSV 10. It is also contemplated that only two of the four wheels 20A, 20B could be driven by the engine 62.

Specifics of the doors 100 will now be described with respect to the right side door 100 illustrated in FIGS. 4 to 17. Details of the right side door 100 apply mutatis mutandis to the left side door 100, the left side door 100 being similar to the right side door 100. It is contemplated that the left side door 100 could be a mirror image of the right side door 100 in some implementations.

Figure 4:
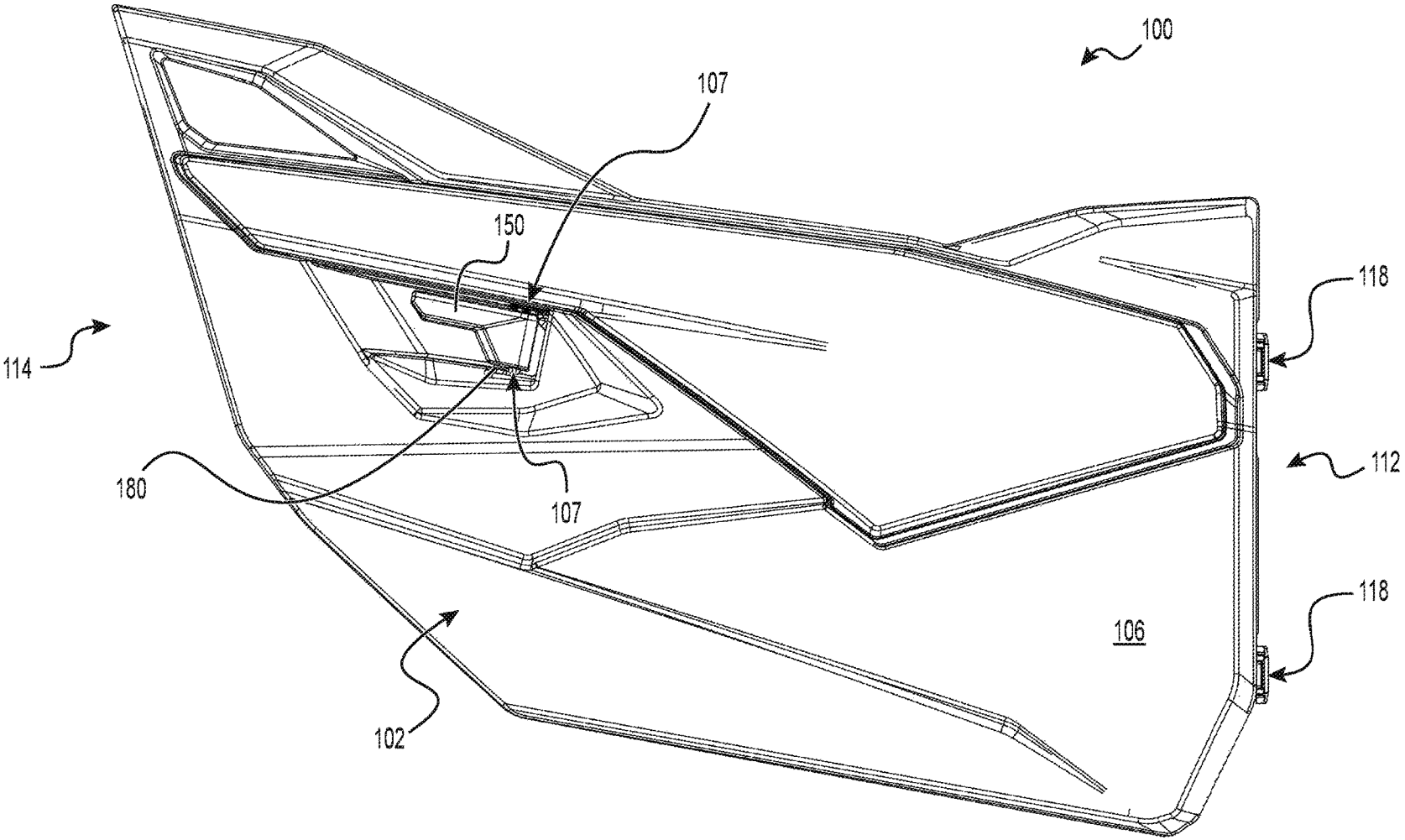
FIG. 4 is a right side elevation view of a right side door of the vehicle of FIG. 1.
Figure 5:
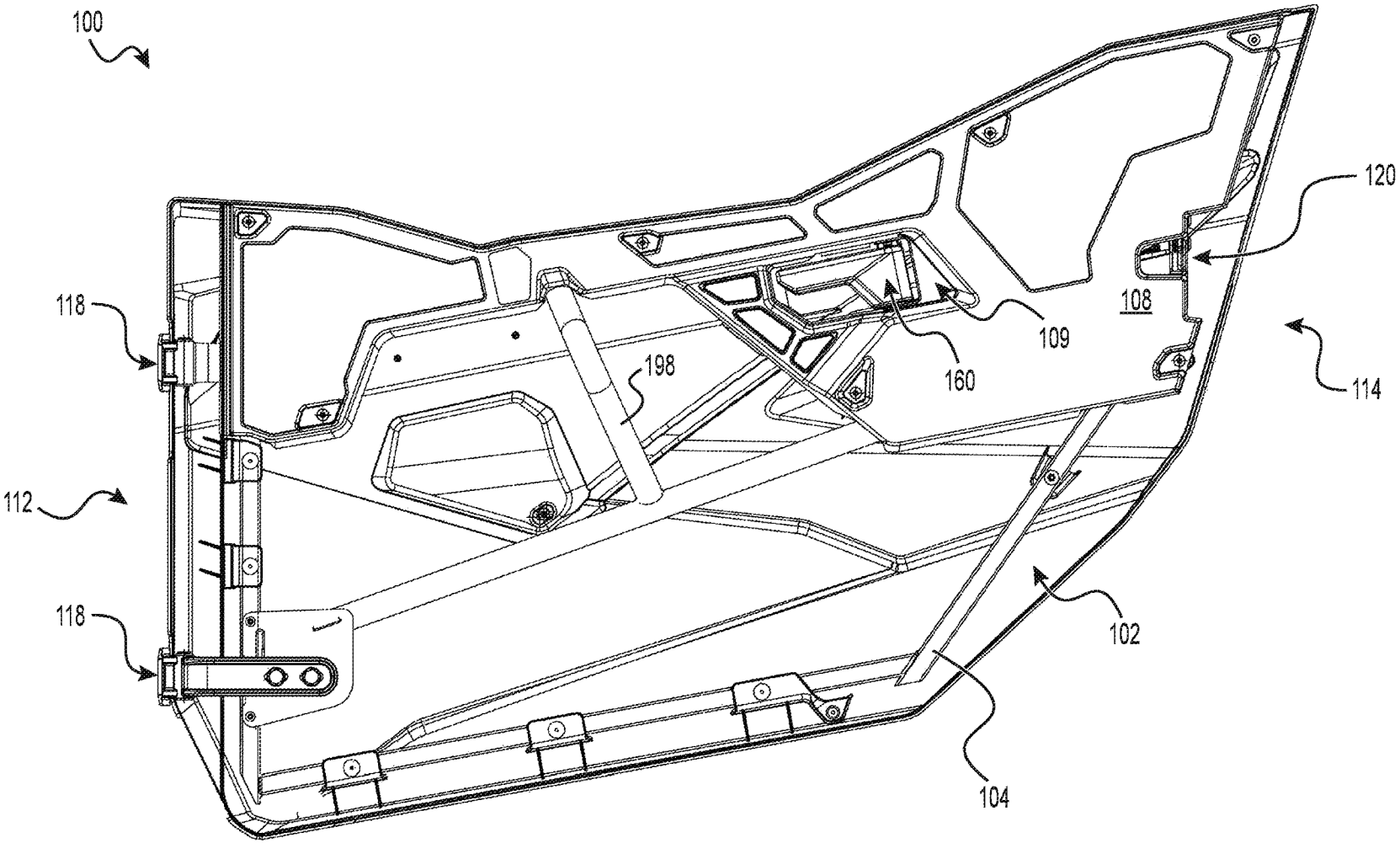
FIG. 5 is a left side elevation view of the right side door of FIG. 4.

The right side door 100 is illustrated fully assembled and in isolation in FIGS. 4 and 5. The door 100 has a door body 102 that includes a door frame 104. The door body 102 further includes an exterior door panel 106 and an interior door panel 108, each connected to the door frame 104. The interior door panel 108, as illustrated, partially covers an interior side of the door 100. Additional interior door panels could be included to cover a larger portion of the interior side of the door 100.

The exterior door panel 106 makes up part of the vehicle body and is composed of the same material as the fenders 56, 60, 61. It is however contemplated that the panel 106 could be made from one or more different materials than the fenders 56, 60, 61. It is also contemplated that the exterior door panel 106 could be replaced by multiple panels. It is also contemplated that the door 100 could include more or fewer interior door panels 108. It is further contemplated that one or both of the door panels 106, 108 could be integral with the door frame 104.

Figure 6:
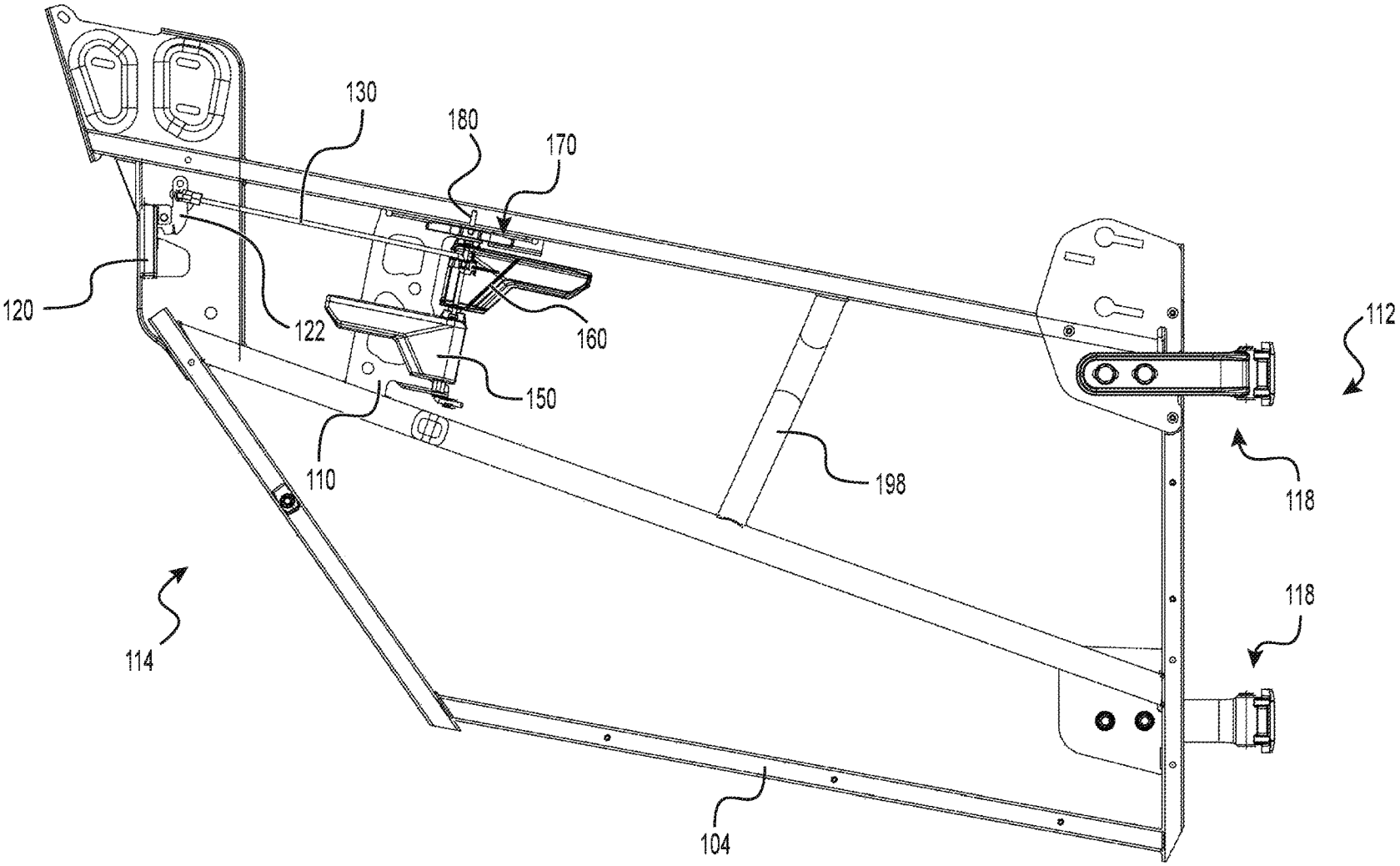
FIG. 6 is a right side elevation view of the right side door of FIG. 4, with door panels removed.
Figure 7:
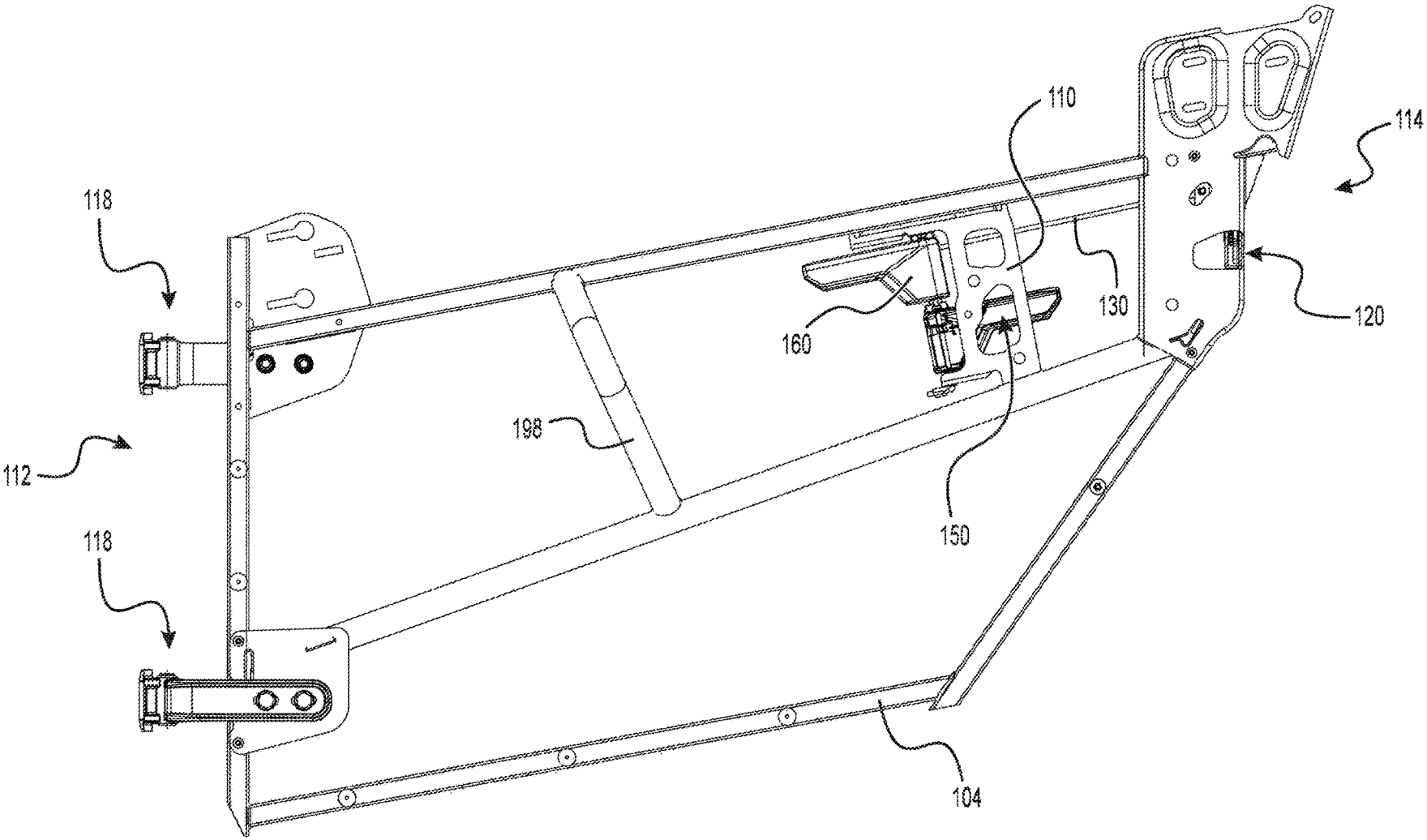
FIG. 7 is a left side elevation view of the right side door of FIG. 4, with door panels removed.
Figure 8:
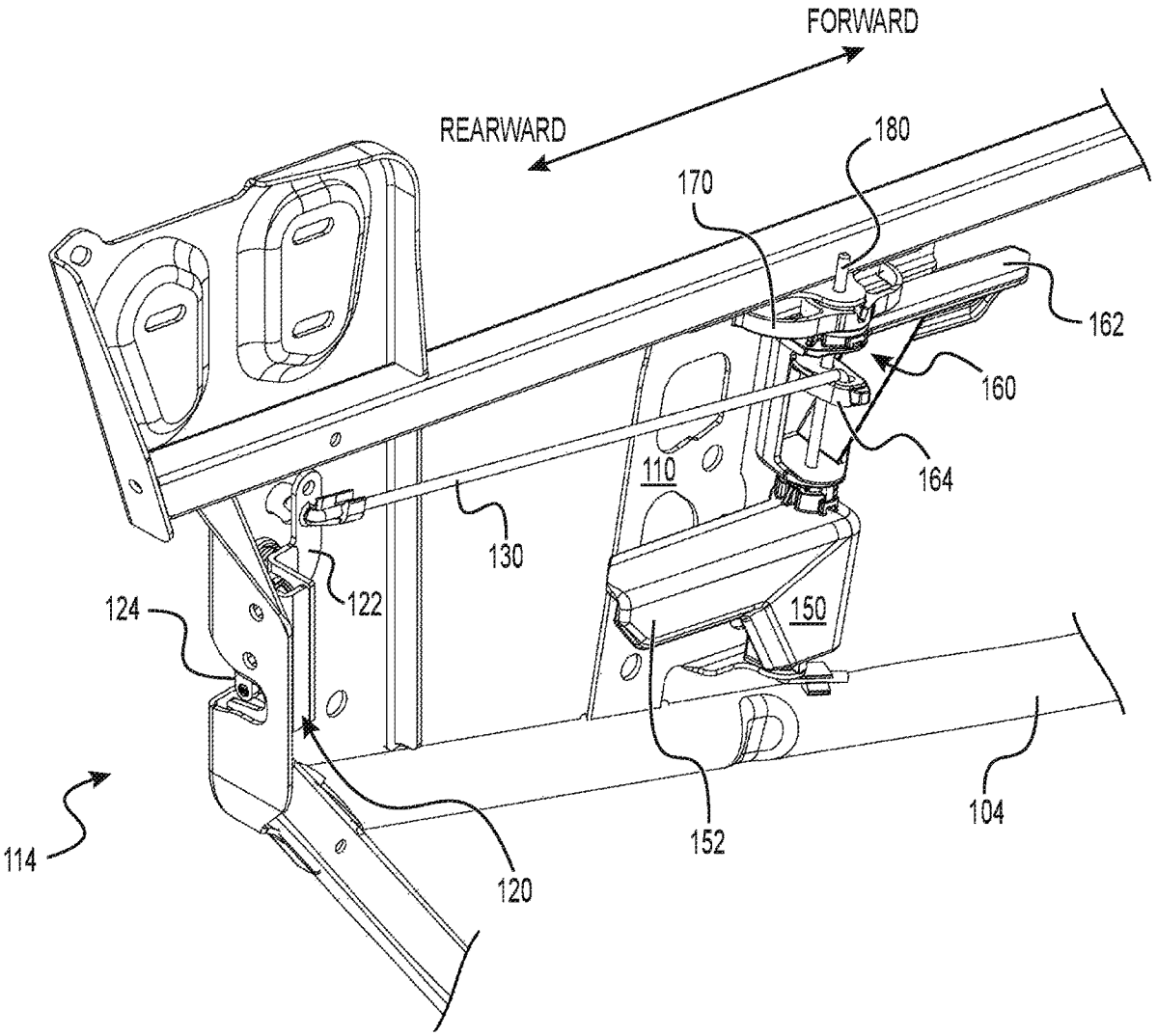
FIG. 8 is a close-up, top, rear, right side perspective view of the right side door of FIG. 4, with door panels removed.
Figure 9:
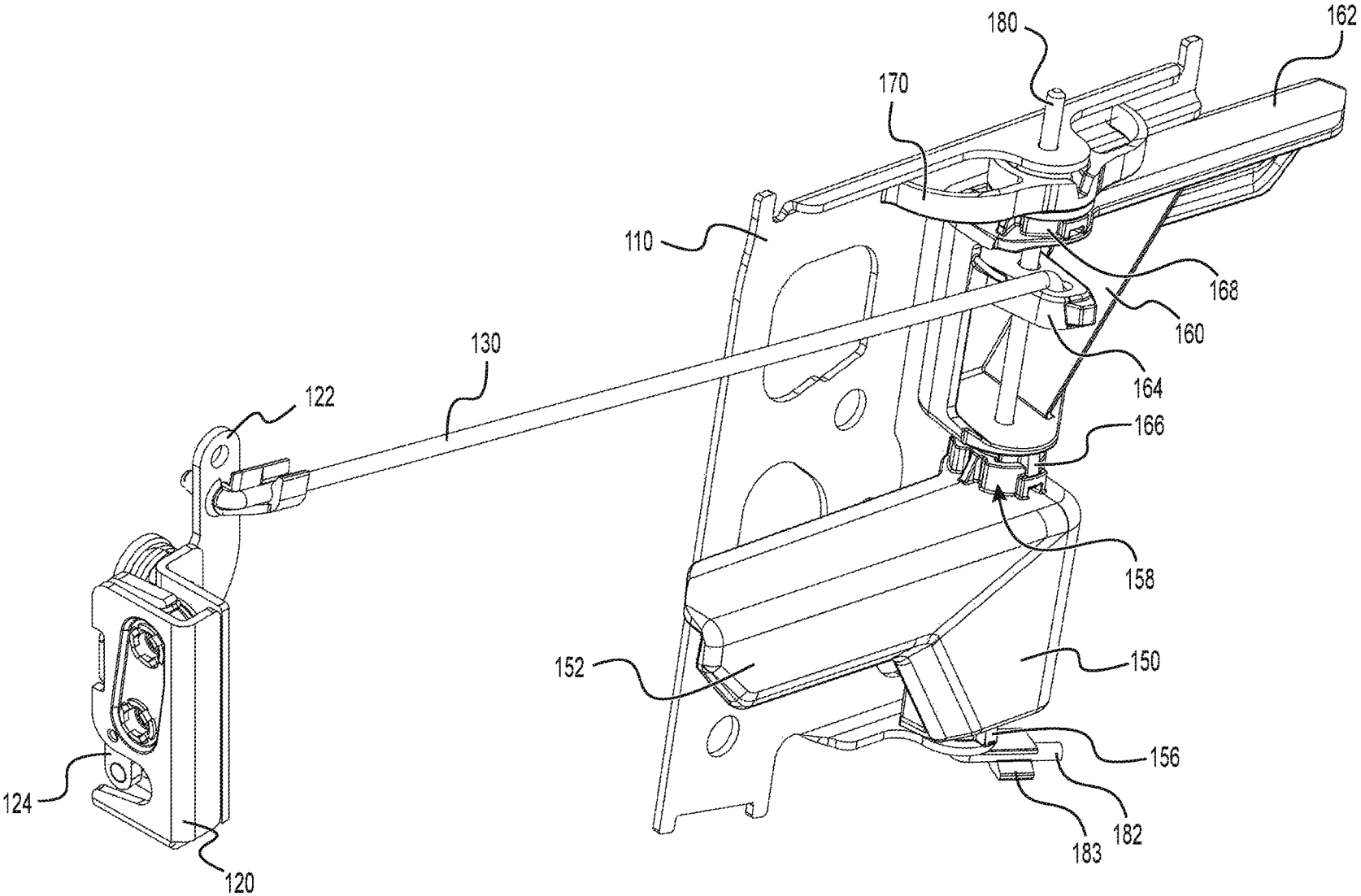
FIG. 9 is the perspective view of FIG. 8, with portions of the frame removed and with handles in a closed position.

The door frame 104 can be seen in more detail where the door panels 106, 108 have been removed in FIGS. 6 to 8. The frame 104 includes a plurality of metal frame portions welded together. It is contemplated that the frame 104 could include more or fewer frame portions than illustrated in the Figures. It is also contemplated that the frame portions could be connected together in a multitude of manners, including but limited to, using fasteners. The right side door frame 104 includes a grip 198, extending through the interior door panel 108, for pivoting the door 100 by an operator inside the vehicle 10. As can be seen in FIG. 1, the left side door 100 includes a grip 199 that is slightly different from the grip 198 on the right side door 100. It is contemplated that the grips 198, 199 may not be present in all implementations of the doors 100. It is also contemplated that the grips 198, 199 could be part of the interior door panel 108. It is further contemplated that the grips 198, 199 could be identical.

Figure 12:
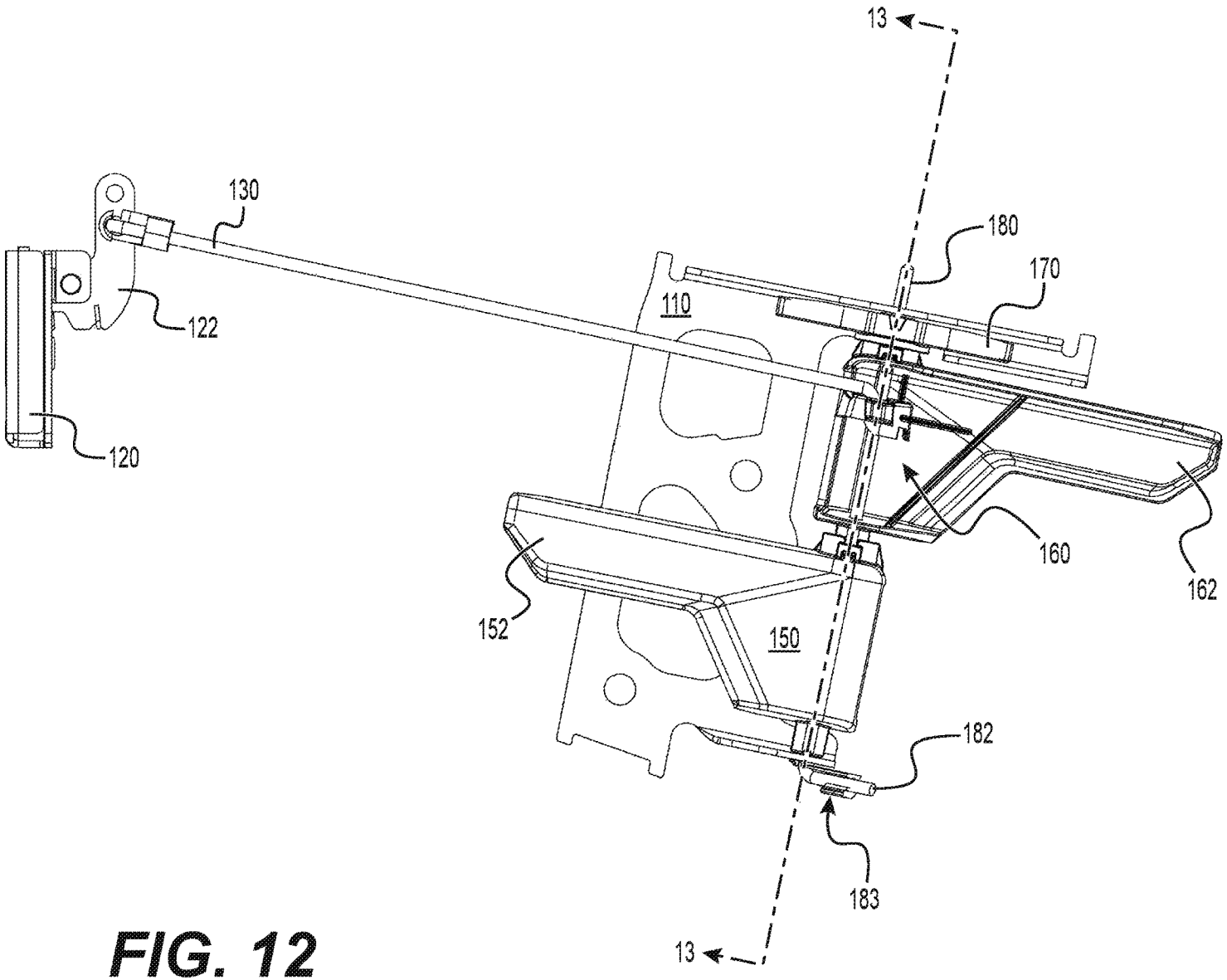
FIG. 12 is a close-up, right side elevation view of the right side door of FIG. 4, with door panels and some portions of the frame removed.
Figure 13:
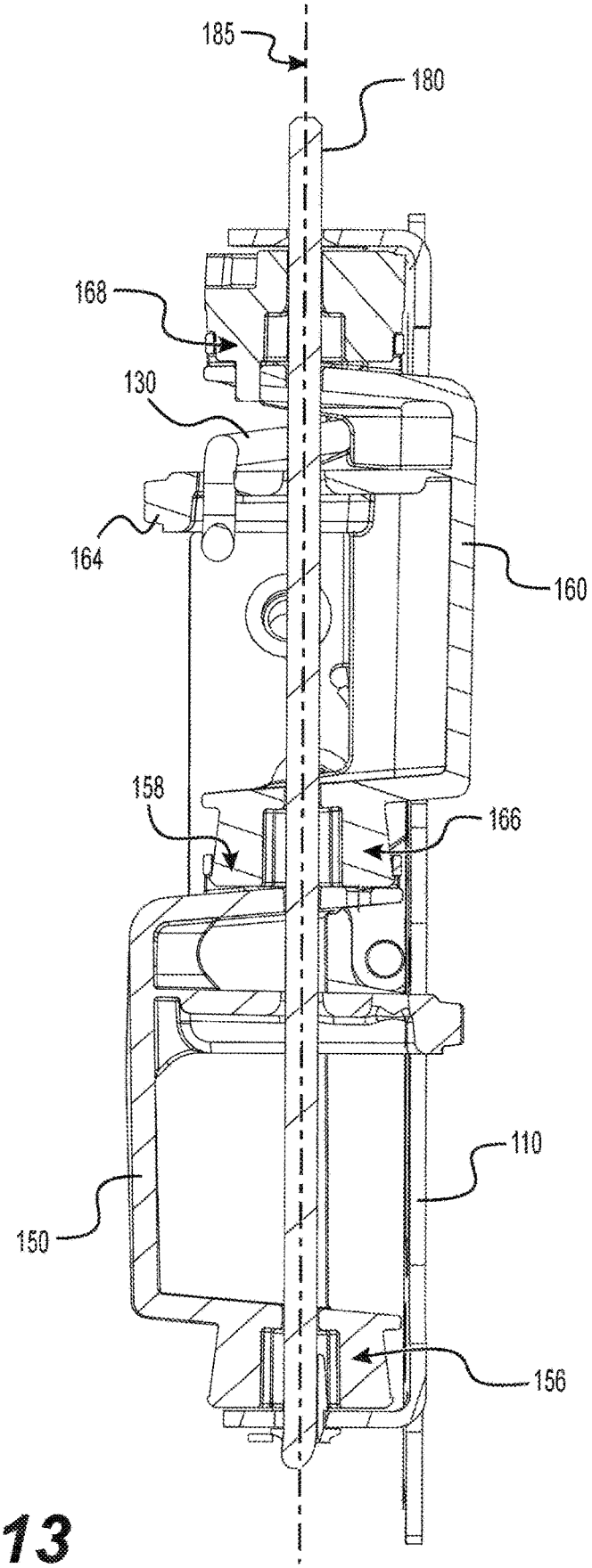
FIG. 13 is a cross-sectional view taken along line 13-13 of FIG. 12.
Figure 14:
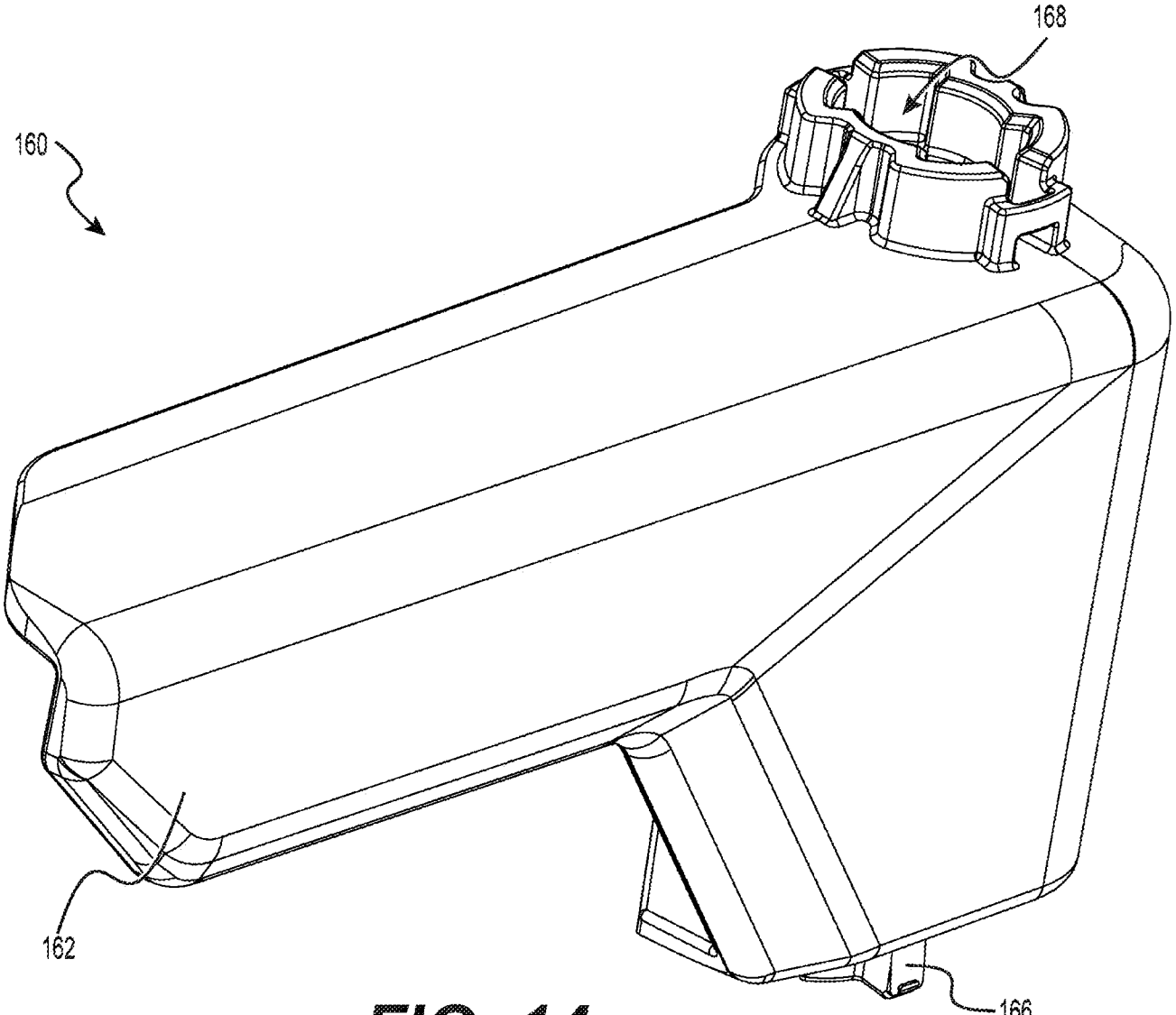
FIG. 14 is a top, front, left side perspective view of an interior handle of the right side door of FIG. 4.

The door 100 includes a plate 110 connected to the door frame 104 for supporting a door handle mechanism. The door 100 also includes an L-shaped shaft 180 connected to the plate 110. The shaft 180 extends generally vertically from a top portion to a bottom portion of the plate 110. The top portion passes through an aperture defined by a portion of the plate 110 extending inward from the plate 110. A bottom portion 182 of the L-shape of the shaft 180 is held by two finger portions of a connector 183 connected to and extending inward from the plate 110, as can be seen in FIG. 12. The connector 183 extends through the bottom of the plate 110, and acts to help prevent vertical movement of the shaft 180. A portion of the shaft 180 passes through apertures 107 in the door panel 106 (see FIG. 4), as will be described below. The shaft 180 supports door handles for the door 100 as will be described in more detail below.

In a front portion 112 of the door 100 are two hinges 118 that pivotably connect the door 100 to the vehicle 10. A front portion of each of the hinges 118 is connected to the vehicle frame 18. A rear portion of each of the hinges 118 is connected to the door frame 104. It is contemplated that the door 100 could include more or fewer hinges 118. It is also contemplated that the door 100 could be pivotably connected to the vehicle frame 18 using different means. It is further contemplated that the hinges 118 could be disposed in a rear of the door 100.

The door 100 includes a rotary latch 120 for selectively maintaining the door 100 in a closed position and selectively releasing the door 100 from the closed position. The latch 120 is connected to the door frame 104 and disposed in a rear portion 114 of the door 100. The latch 120 selectively engages with and fastens therein a striker 95 (FIG. 3) which extends from the vehicle frame 18 into the lateral passage 32. When the door 100 is in the closed position and the latch 120 is in a locked position, the door 100 is prevented from pivoting with respect to the vehicle (the door 100 is prevented from opening). When the latch 120 is in an unlocked position, the latch 120 releases the striker 95 and the door 100 is allowed to pivot with respect to the vehicle 10. It should be noted that the "locked position" and "unlocked position" of the latch 120 refer to the state of the latch 120. In the locked position, the latch 120 is positioned to fasten the striker 95 therein; in the unlocked position, the latch 120 is positioned to release the striker 95. These labels are unrelated to securing the door 100 by a lock and key mechanism. The door 100 generally does not include a lock and key mechanism as it is a half-door which does not fully close the vehicle 10, although it may be provided in some implementations.

Further details of the rotary latch 120 can be found in at least U.S. Pat. No. 6,471,260 B1, published Oct. 29, 2002, the entirety of which is incorporated herein by reference. It is contemplated that the rotary latch 120 could be replaced with a different type of latch mechanism in some implementations.

The door 100 includes two handles 150, 160 for selectively moving the rotary latch 120 between the locked and unlocked positions, as will be described in more detail below.

The door 100 includes an exterior handle 150 accessible from an exterior of the vehicle 10, disposed on an exterior side of the door body 102. The exterior handle 150 is rotatably disposed on the shaft 180, the shaft 180 passing through apertures defined by the handle 150 (see FIG. 13) where the apertures are large enough to allow free rotation of the handle 150 with respect to the shaft 180. The handle 150 rotates about a rotation axis 185, defined along a center of a portion of the shaft 180 (see FIG. 10). As is shown in FIG. 4, a portion of shaft 180 extends from the door body 102 through apertures 107 in the exterior panel 106; the handle 150 is disposed on that portion of the shaft 180 and a portion of the handle 150 passes through a top one of the apertures 107. The exterior handle 150 includes a lever portion 152 extending rearward which the operator pulls in order to rotate the handle 150. It is contemplated that the lever portion 152 could instead extend forward from the rotation axis 185 in some implementations.

The door 100 also includes an interior handle 160 accessible from an interior of the vehicle 10, disposed on an interior side of the door body 102. The interior handle 160 is further shown in isolation in FIGS. 14 to 17.

The interior handle 160 is similarly rotatably disposed on the shaft 180. The shaft 180 extends through apertures defined in the handle 160 (see FIGS. 13 and 17) with sufficient clearance to allow free rotation of the handle 150 with respect to the shaft 180. Further, the interior handle 160 rotates about the same rotation axis 185 as the exterior handle 150. The handle 160 is disposed on the shaft 180 and a portion of the handle 160 passes through an aperture 109 in the door panel 108 (see FIG. 5). The interior handle 160 includes a lever portion 162 extending forward which the operator pulls in order to rotate the handle 160. It is contemplated that the lever portion 162 could instead extend rearward from the rotation axis 185 in some implementations.

In the present implementation, the interior handle 160 and the exterior handle 150 are identical. In some implementations, it is contemplated that the handles 150, 160 could be different. While the present handles 150, 160 rotate generally horizontally about the generally vertical shaft 180, it is contemplated that the shaft 180 could extend more horizontally and the handles 150, 160 may be rotated in a more vertical direction in some implementations.

As can be seen from at least FIGS. 8 to 13, the handles 150, 160 are connected together with a fixed relative orientation. In the present implementation the exterior handle 150 is connected to a bottom of the interior handle 160, although it is contemplated that their placement could be reversed in other implementations. Specifically, a protrusion 166 of a bottom of the handle 160 is received and snapped into a recess 158 defined by a top of the handle 150, as can be seen in the cross-section of FIG. 13. As the handles 150, 160 are identical, the handle 150 includes a protrusion 156 and the handle 160 similarly defines a recess 168. In FIGS. 14 to 17, the protrusion 166 and the recess 168 can be seen in more detail. The protrusion 156 and the recess 158 of the handle 150 are identical to the protrusion 166 and the recess 168 respectively.

Figure 15:
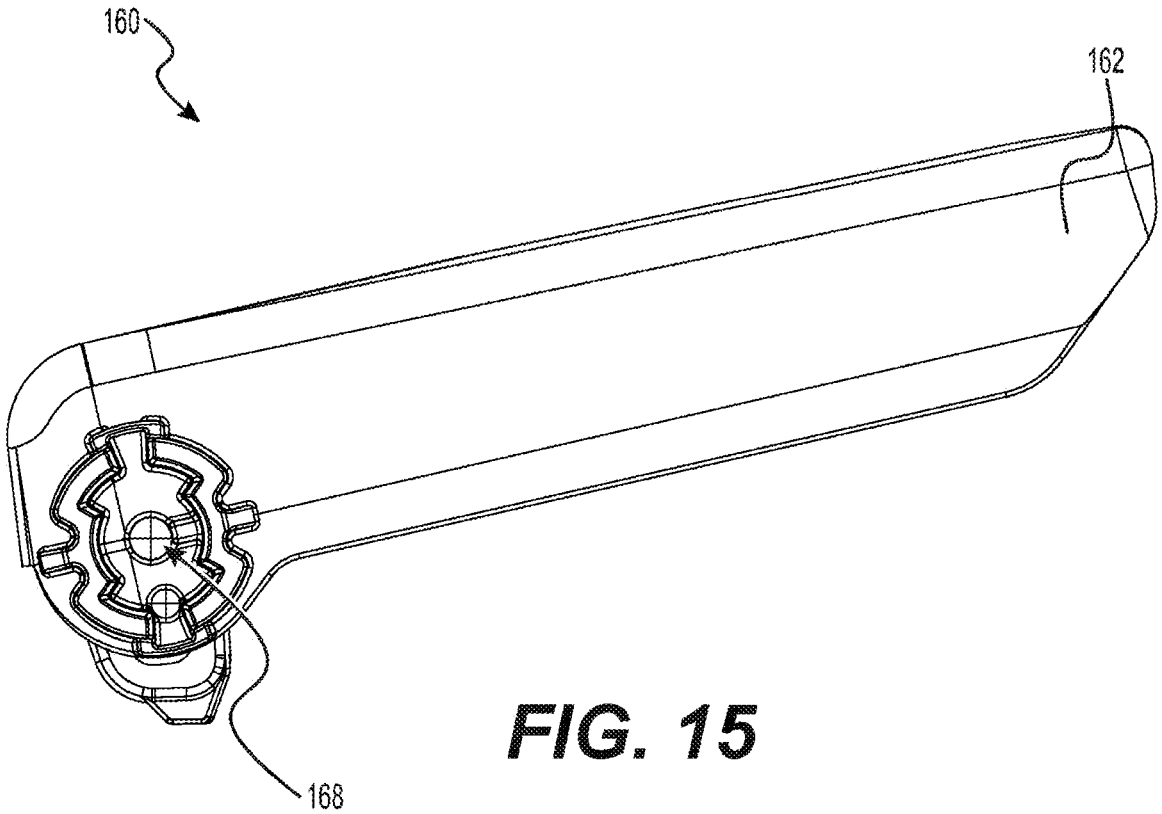
FIG. 15 is a top plan view of the interior handle of FIG. 14.
Figure 16:
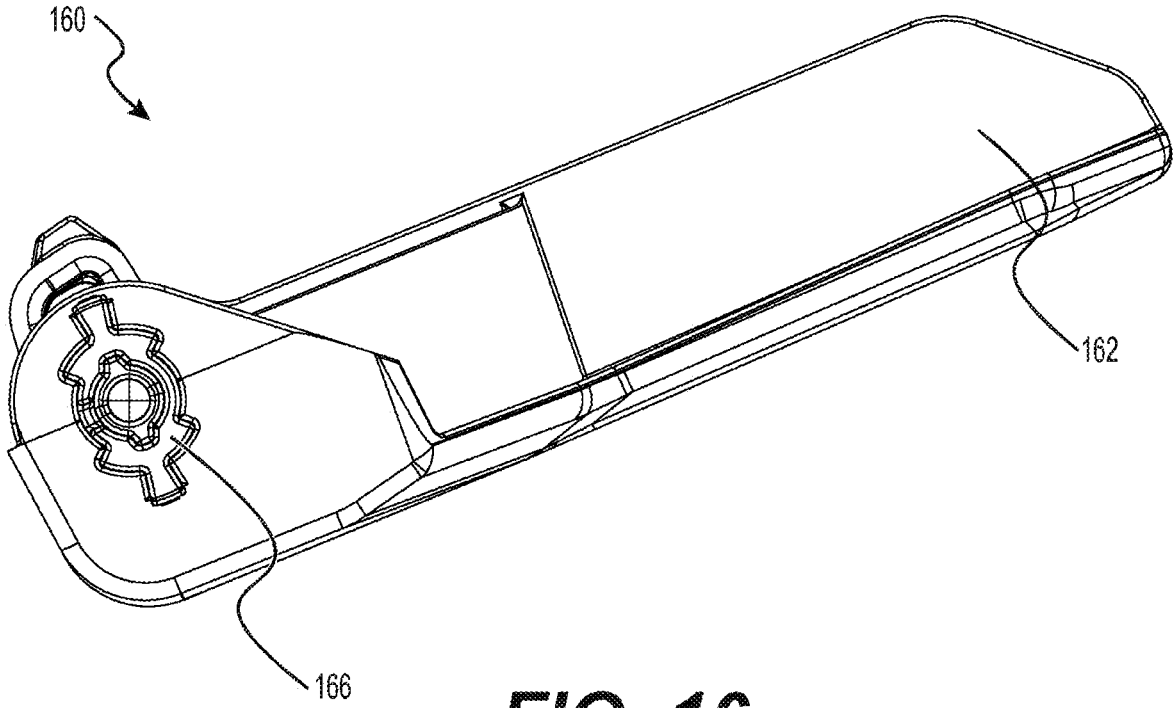
FIG. 16 is a bottom plan view of the interior handle of FIG. 14.
Figure 17:
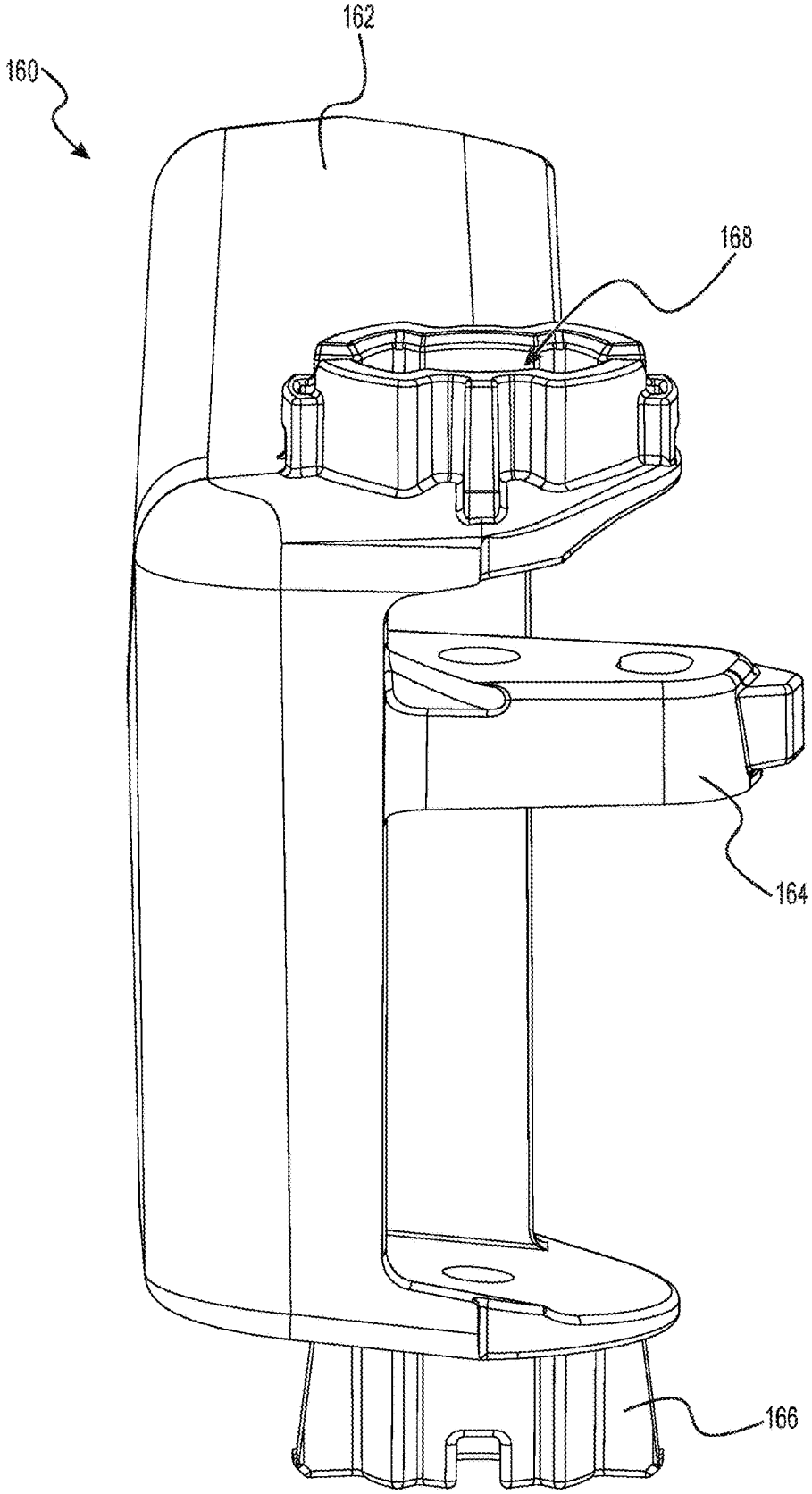
FIG. 17 is a top, rear side perspective view of the interior handle of FIG. 14.

Each of the recesses 158, 168 are shaped congruous to each of the protrusions 156, 166, as can be seen in FIGS. 15 and 16. As such, the recess 158 and the protrusion 166 fit snugly together and the handles 150, 160 rotate simultaneously when one of the handles 150, 160 is turned by a user.

It is contemplated that the handles 150, 160 could define different forms that fit together in order to connect the handles 150, 160 together, depending on the implementation. It is also contemplated that the handles 150, 160 could be integrally formed into a single part. It is further contemplated that the handles 150, 160 could be connected in different manners, including but not limited to: by fastening the handles 150, 160 together, by gluing the handles 150, 160 together, and by inserting a portion of one handle into an other such that the handles 150, 160 turn together while remaining easily separable.

Figure 10:
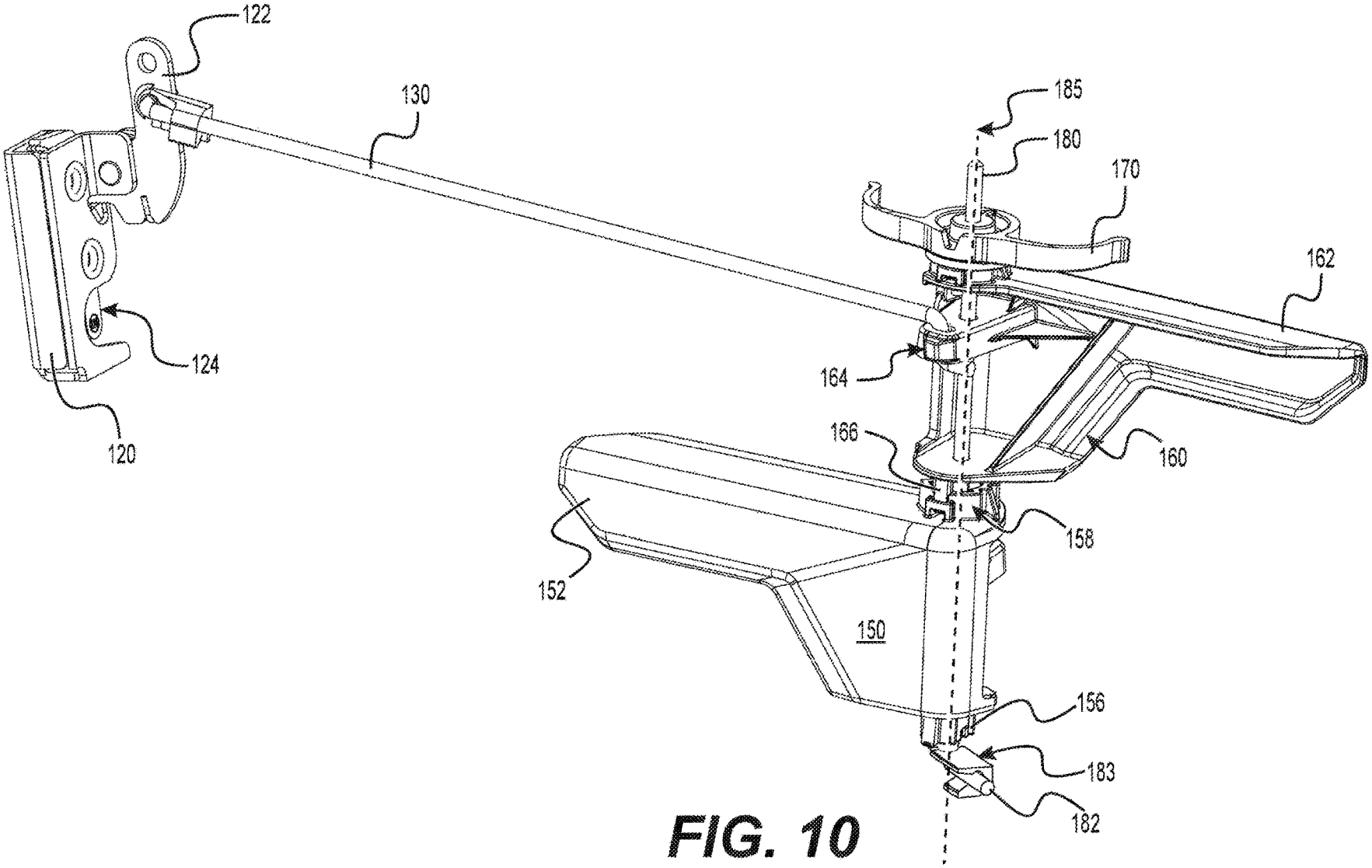
FIG. 10 is a top, front, right side perspective view of the right side door of FIG. 4, with the door panels and portions of the frame having been removed.
Figure 11:
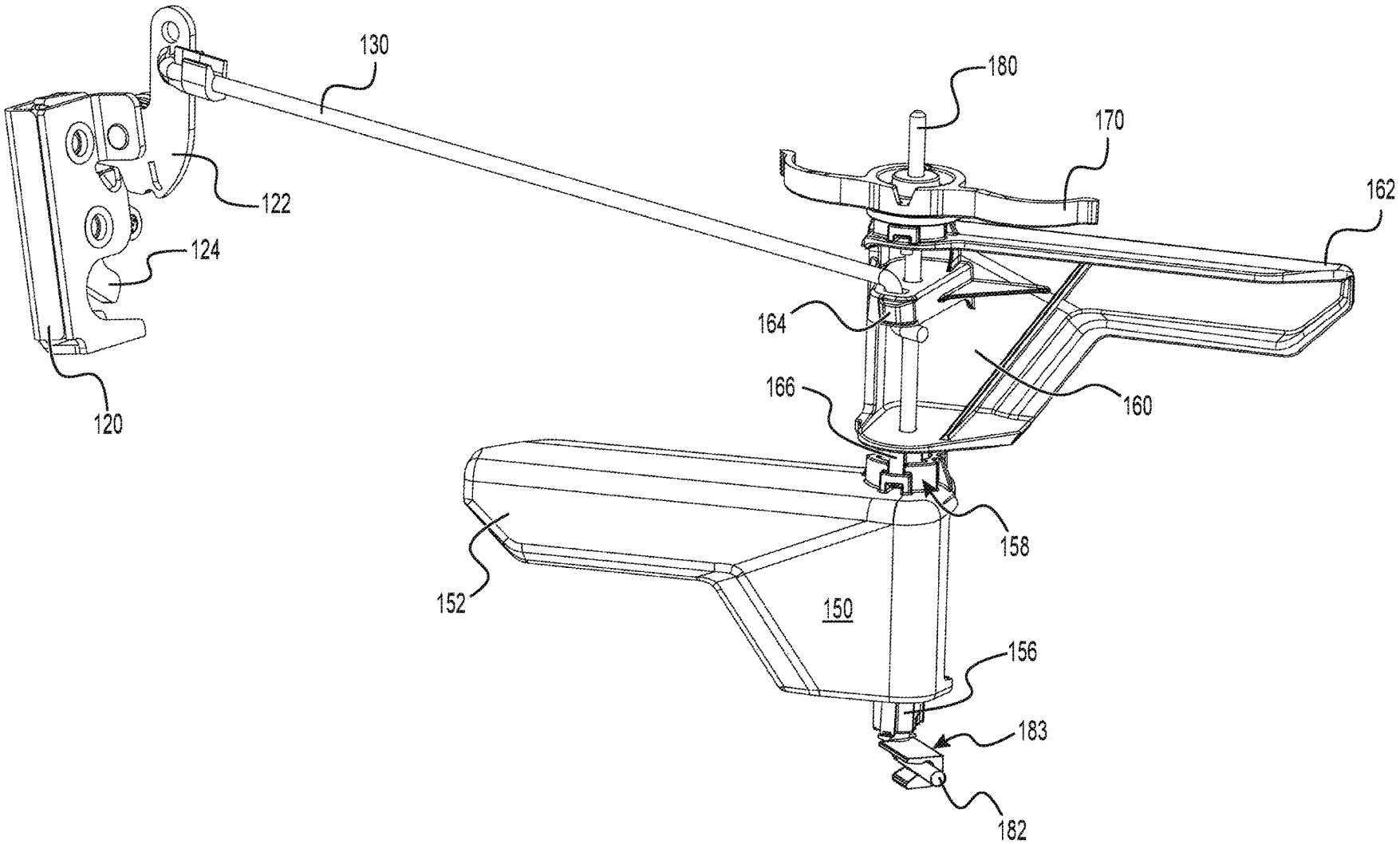
FIG. 11 is the perspective view of FIG. 10, with the handles having been rotated to an open position.

Each handle 150, 160 is rotatable between a closed position, illustrated in FIG. 10, and an open position, illustrated in FIG. 11. Since the handles 150, 160 are snapped together in the present implementation, rotation of the either one of the handles 150, 160 by the operator causes an equal rotation of the other one of the handles 150, 160. As they rotate together, at any given time the handles 150, 160 will be both in the closed position, both in the open position, or both in intermediate positions. It is contemplated that in some implementations the handles 150, 160 could be operatively connected together through an intervening mechanism, such that the handles 150, 160 need not always rotate together. It is also contemplated that the rotation of the handles 150, 160 could be completely decoupled such that each of the handles 150, 160 could be rotated independently. As such, in some implementations one of the handles 150, 160 could be in the closed position, while the other one could be in the open or intermediate position for that handle 150, 160.

The door 100 includes a rod 130 which connects the handles 150, 160 to the latch 120. Rotation of the handles 150, 160 moves the rod 130 to cause the latch 120 to move between the locked and unlocked positions, as will be described below. A front end of the rod 130 passes through a latch lever 122 of the rotary latch 120 to fasten the rod 130 to the latch 120. The handle 160 includes an anchoring portion 164 to which a rear end of the rod 130 is connected. It is contemplated that the rod 130 could be connected to the handle 150 instead. It is also contemplated that the rod 130 could be connected to an intervening mechanism that is operatively connected to the two handles 150, 160. It is further contemplated that the rod 130 could be replaced by different connection means, including but limited to, a cord and a wire.

The door 100 includes a biasing element 170 disposed on the shaft 180 and connected to the exterior handle 160. The biasing element 170 biases the interior handle 160 toward the closed position; as the handles 150, 160 are connected, both handles 150, 160 are de facto biased toward the closed position. In the implementation illustrated in the Figures, the biasing element 170 is a leaf spring 170. The shaft 180 extends through a hole in a center of the spring 170, a central portion of the spring 170 is connected to the handle 160, and two end portions of the spring 170 contact the plate 110.

It is contemplated that the spring 170 could be connected instead to the exterior handle 150. It is also contemplated that handles 150, 160 could be connected together using an intervening mechanism, as mentioned above, and that the spring 170 could be connected to that mechanism. The leaf spring 170 is further only one example of a biasing element that can be implemented as the biasing element 170. It is contemplated that the biasing element 170 could be implemented using different biasing elements including, but not limited to, a torsion spring. In implementations where the rotation is decoupled between the handles 150, 160, it is contemplated that the biasing element 170 could be used to bias each of the handles 150, 160 to the closed position. It is also contemplated that the door 100 could include more than one biasing element for biasing the handles 150, 160 toward the closed position. It is further contemplated that the latch 120 could provide a biasing force on the rod 130 to bias the handles 150, 160 toward the closed position.

As the shaft 180 extends through, but is not connected to, the handles 150, 160 and the spring 170, it is contemplated that any or all of these parts 150, 160, 170 could be selectively removed from the door 100, to be repaired or replaced, for example. The bottom portion 182 of the shaft 180 would be removed from the finger portions of the connector 183, and then the shaft 180 would be extracted from the parts 150, 160, 170 by pulling the shaft 180 downward. Once the appropriate part has been repaired or replaced, the parts 150, 160, 170 are simply aligned with the plate 110, and the shaft 180 is inserted, bottom to top, through apertures in the plate 110, the handles 150, 160, the spring 170, and the top aperture in the plate 110. The shaft 180 is then fixed in place by rotating the bottom portion 182 and snapping the bottom portion 182 into place between the fingers portions of the connector 183.

Operation of the rotary latch and the handles 150, 160 to selectively open and close the door 100 will now be described in more detail with reference to FIGS. 10 and 11. The latch 120 includes a rotary jaw 124 which is selectively movable between a locked position, illustrated in FIG. 10, and an unlocked position, illustrated in FIG. 11. The rotary jaw 124 biased toward the unlocked position for receiving the striker 95 in the jaw 124 when moving the door 100 to the closed position. When the door 100 is moved from the opened to the closed position, the striker 95 is received in the jaw 124, and the striker 95, along with the weight of the door 100, pushes the jaw 124, and thus the latch 120, into the locked position. The striker 95 is then held by the jaw 124 in the latch 120 in the locked position and the door 100 is held in the closed position.

To open the door 100 from the closed position, one of the lever portions 152, 162 is rotated away from the door 100. Looking from above the door 100, the lever portions 152, 162 are rotated in a counter-clockwise direction for the right door 100, and a clockwise direction for the left door 100. It is contemplated that these directions could be reversed, depending on specific implementation details.

Rotation of the handles 150, 160 causes the rod 130 to be pulled forward (by the anchoring portion 164). The rod 130 in turn pulls the lever 122 forward, which causes the latch 120 to release the rotary jaw 124 to move from the locked position to the unlocked position, releasing the striker 95 from the latch 120. The door 100 can now pivot with respect to the vehicle 10 and can be opened by the operator from the interior or the exterior of the vehicle 10 (without needing to reach over a top of the door 100). Once the operator has opened the door 100, the handle 150 or 160 is released, and the spring 170 biases the handles 150, 160 back to the closed position.

To close the door 100 from the opened position, the door 100 is simply either pushed from an exterior of the door 100 or pulled from an interior side of the door (including by using the grip 198) toward the closed position. As the door 100 approaches the closed position, the jaw 124 (having been biased toward the unlocked position) receives the striker 95 therein. The force from the door 100 moving toward the striker 95 then allows the striker 95 to push the jaw 124 and the latch 120 into the locked position. The door 100 is then in the closed position, until one of the handles 150, 160 is used to open the door 100.

The door and vehicle implemented in accordance with some non-limiting implementations of the present technology can be represented as follows, presented in numbered clauses.

CLAUSE 1: A door (100) for a vehicle (10), comprising a door body (102); a latch (120) connected to the door body (102), the latch (120) being selectively movable between a locked position and an unlocked position; a first handle (150) rotatably connected to the door body (102), the first handle (150) being accessible from an exterior side of the door body (102); a second handle (160) rotatably connected to the door body (102), the second handle (160) being accessible from an interior side of the door body (102); and a rod (130) connected between the latch (120) and at least one of the first handle (150) and the second handle (160), the first handle (150) and the second handle (160) rotating about a common rotation axis (185), the first handle (150) being rotatable between a first position and a second position, the second handle (160) being rotatable between a third position and a fourth position, the latch (120) being in the locked position when the first handle (150) is in the first position and the second handle (160) is in the third position, the latch (120) being in the unlocked position when the first handle (150) is in the second position and the second handle (160) is in any position, the latch (120) being in the unlocked position also when the second handle (160) is in the fourth position and the first handle (150) is in any position, when the door (100) is pivotably mounted to the vehicle (10): the locked position of the latch (120) preventing the door (100) from pivoting with respect to the vehicle (10) when the door (100) is in a closed position, the unlocked position of the latch (120) allowing the door (100) to pivot with respect to the vehicle (10).

CLAUSE 2. The door (100) of clause 1, wherein the first handle (150) is operatively connected to the second handle (160) such that rotation of one of the first handle (150) and the second handle (160) causes an other one of the first handle (150) and the second handle (160) to rotate; the first handle (150) is in the first position when the second handle (160) is in the third position; and the first handle (150) is in the second position when the second handle (160) is in the fourth position.

CLAUSE 3. The door (100) of clause 2, wherein the first handle (150) and the second handle (160) have a fixed relative orientation to each other such that rotation of the one of the first and second handles (150, 160) causes an equal rotation of the other one of the first and second handles (150, 160).

CLAUSE 4. The door (100) of clause 2 or 3, wherein: at least one of the first handle (150) and the second handle (160) includes a protrusion (166); at least an other one of the first handle (150) and the second handle (160) defines a recess (158); and the first handle (150) and the second handle (160) are connected together by the protrusion (166) being received in the recess (158).

CLAUSE 5. The door (100) of any one of clauses 1 to 4, wherein the first handle (150) and the second handle (160) rotate in a same direction about the rotation axis (185).

CLAUSE 6. The door (100) of any one of clauses 1 to 5, wherein the latch (120) is disposed in a rear portion (114) of the door (100); and the door (100) further comprises at least one hinge (118) connected to a front portion (112) of the door (100) for pivotably connecting the door (100) to the vehicle (10).

CLAUSE 7. The door (100) of any one of clauses 1 to 6, wherein the first handle (150) is biased toward the first position and the second handle (160) is biased toward the third position.

CLAUSE 8. The door (100) of clause 7, further comprising a biasing element (170) operatively connected to at least one of the first handle (150) and the second handle (160).

CLAUSE 9. The door (100) of clause 8, wherein the biasing element (170) is a leaf spring (170).

CLAUSE 10. The door (100) of any one of clauses 1 to 9, further comprising a shaft (180) connected the door body (102); and wherein the first handle (150) and the second handle (160) are rotatably disposed on the shaft (180).

CLAUSE 11. The door (100) of any one of clauses 1 to 10, wherein a lever portion (152) of the first handle (150) extends away from the rotation axis (185) in a first direction; and a lever portion (162) of the second handle (160) extends away from the rotation axis (185) in a second direction, the second direction being opposite the first direction.

CLAUSE 12. The door (100) of any one of clauses 1 to 11, wherein the latch (120) is biased toward the unlocked position.

CLAUSE 13. The door (100) of clause 10, wherein the door body (102) includes a door frame (104), and at least one door panel (106, 108); the at least one door panel (106, 108) defining at least one aperture (107, 109) through which extends at least one of the first handle (150), the second handle (160), and the shaft (180); and the first handle (150) and the second handle (160) are rotatably connected to the door frame (104).

CLAUSE 14. A vehicle (10) comprising a frame (18); two front wheels (24) operatively connected to the frame (18); two rear wheels (24) operatively connected to the frame (18); at least one seat (28) connected to the frame (18); a motor (62) connected to the frame (18), the motor (62) being operatively connected to at least one of the two front wheels (24); and the two rear wheels (24); and at least one door (100) connected to the frame (18), the at least one door (100) including a door body (102); a latch (120) connected to the door body (102), the latch (120) being selectively movable between a locked position and an unlocked position; a first handle (150) rotatably connected to the door body (102), the first handle (150) being located on an exterior side of the vehicle (10); a second handle (160) rotatably connected to the door body (102), the second handle (160) being located on an interior of the vehicle (10); and a rod (130) connected between the latch (120) and at least one of the first handle (150) and the second handle (160), the first handle (150) and the second handle (160) rotating about a common rotation axis (185), the first handle (150) being rotatable between a first position and a second position, the second handle (160) being rotatable between a third position and a fourth position, the latch (120) being in the locked position when the first handle (150) is in the first position and the second handle (160) is in the third position, the latch (120) being in the unlocked position when the first handle (150) is in the second position and the second handle (160) is in any position, the latch (120) being in the unlocked position also when the second handle (160) is in the fourth position and the first handle (150) is in any position, the locked position of the latch (120) preventing the at least one door (100) from pivoting with respect to the vehicle (10) when the door (100) is in a closed position, the unlocked position of the latch (120) allowing the at least one door (100) to pivot with respect to the vehicle (10).

CLAUSE 15. The vehicle (10) of clause 14, wherein the first handle (150) is operatively connected to the second handle (160) such that rotation of one of the first handle (150) and the second handle (160) causes an other one of the first handle (150) and the second handle (160) to rotate; the first handle (150) is in the first position when the second handle (160) is in the third position; and the first handle (150) is in the second position when the second handle (160) is in the fourth position.

CLAUSE 16. The vehicle (10) of clause 15, wherein the first handle (150) and the second handle (160) have a fixed relative orientation to each other such that rotation of the one of the first and second handles (150, 160) causes an equal rotation of the other one of the first and second handles (150, 160).

CLAUSE 17. The vehicle (10) of any one of clauses 14 to 16, wherein the latch (120) is disposed in a rear portion (114) of the at least one door (100); the at least one door (100) further comprises at least one hinge (118) connected to a front portion (112) of the at least one door (100); and the at least one hinge (118) pivotably connects the at least one door (100) to the vehicle (10).

CLAUSE 18. The vehicle (10) of any one of clauses 14 to 17, wherein the at least one door (100) further comprises a biasing element (170) operatively connected to at least one of the first handle (150) and the second handle (160); and the biasing element (170) biases the first handle (150) toward the first position and the second handle (160) toward the third position.

CLAUSE 19. The vehicle (10) of any one of clauses 14 to 18, wherein the at least one door (100) further comprises a shaft (180) connected the door body (102); and the first handle (150) and the second handle (160) are rotatably disposed on the shaft (180).

CLAUSE 20. The vehicle (10) of any one of clauses 14 to 19, further comprising a striker (95) connected to the frame (18), the latch (120) being fastened to the striker (95) when the door (100) is in the closed position and the latch (120) is in the locked position.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A door for a vehicle, comprising:
a door body;
a latch connected to the door body, the latch being selectively movable between a locked position and an unlocked position;
a shaft connected to the door body;
a first handle rotatably connected to the door body, the first handle being accessible from an exterior side of the door body,
the first handle including:
a first handle body, and
a first lever portion integrally connected to the first handle body;
a second handle rotatably connected to the door body, the second handle being accessible from an interior side of the door body,
the second handle including:
a second handle body, and
a second lever portion integrally connected to the second handle body,
the first handle and the second handle being rotatably disposed on the shaft; and
a rod connected between the latch and at least one of the first handle and the second handle,
the first handle and the second handle rotating about a common rotation axis about the shaft, the first handle body of the first handle and the second lever portion of the second handle being shaped to fit together and be in direct contact with each other,
the first handle being rotatable between a first position and a second position, the second handle being rotatable between a third position and a fourth position,
the latch being in the locked position when the first handle is in the first position and the second handle is in the third position,
the latch being in the unlocked position when the first handle is in the second position and the second handle is in any position, the latch being in the unlocked position also when the second handle is in the fourth position and the first handle is in any position,
when the door is pivotably mounted to the vehicle:
the locked position of the latch preventing the door from pivoting with respect to the vehicle when the door is in a closed position,
the unlocked position of the latch allowing the door to pivot with respect to the vehicle.

2. The door of claim 1, wherein:
the first handle is operatively connected to the second handle such that rotation of one of the first handle and the second handle causes an other one of the first handle and the second handle to rotate;
the first handle is in the first position when the second handle is in the third position; and
the first handle is in the second position when the second handle is in the fourth position.

3. The door of claim 2, wherein the first handle and the second handle have a fixed relative orientation to each other such that rotation of the one of the first and second handles causes an equal rotation of the other one of the first and second handles.

4. The door of claim 2, wherein:
one of the first handle and the second handle includes:
a first protrusion, and
a first recess defined on a side of the one of the first handle and the second handle opposite the first protrusion;
an other one of the first handle and the second handle includes:
a second protrusion, and
a second recess defined on a side of the other one of the first handle and the second handle opposite the second protrusion; and
the first handle and the second handle are connected together by the first protrusion being received in the second recess.

5. The door of claim 2, wherein the first handle and the second handle rotate in a same direction about the rotation axis.

6. The door of claim 1, wherein:
the latch is disposed in a rear portion of the door; and
the door further comprises at least one hinge connected to a front portion of the door for pivotably connecting the door to the vehicle.

7. The door of claim 1, wherein the first handle is biased toward the first position and the second handle is biased toward the third position.

8. The door of claim 7, further comprising a biasing element operatively connected to at least one of the first handle and the second handle.

9. The door of claim 8, wherein the biasing element is a leaf spring.

10. The door of claim 1, wherein the rotation axis is oriented parallel to an outer surface of the door.

11. The door of claim 1, wherein:
a lever portion of the first handle extends away from the rotation axis in a first direction; and
a lever portion of the second handle extends away from the rotation axis in a second direction, the second direction being opposite the first direction.

12. The door of claim 1, wherein the latch is biased toward the unlocked position.

13. The door of claim 1, wherein:
the door body includes:
a door frame, and
at least one door panel;
the at least one door panel defining at least one aperture through which extends at least one of:

the first handle,
the second handle, and
the shaft; and
the first handle and the second handle are rotatably connected to the door frame.

14. A vehicle comprising:
a frame;
two front wheels operatively connected to the frame;
two rear wheels operatively connected to the frame;
at least one seat connected to the frame;
a motor connected to the frame, the motor being operatively connected to at least one of:
the two front wheels; and
the two rear wheels; and
at least one door connected to the frame, the at least one door including:
a door body;
a latch connected to the door body, the latch being selectively movable between a locked position and an unlocked position;
a first handle rotatably connected to the door body, the first handle being located on an exterior side of the vehicle,
the first handle including:
a first handle body, and
a first lever portion integrally connected to the first handle body;
a second handle rotatably connected to the door body, the second handle being located on an interior of the vehicle,
the second handle including:
a second handle body, and
a second lever portion integrally connected to the second handle body; and
a rod connected between the latch and at least one of the first handle and the second handle,
the first handle and the second handle rotating about a common rotation axis, the first handle body of the first handle and the second lever portion of the second handle being shaped to fit together and be in direct contact with each other,
the first handle being rotatable between a first position and a second position, the second handle being rotatable between a third position and a fourth position, the latch being in the locked position when the first handle is in the first position and the second handle is in the third position,
the latch being in the unlocked position when the first handle is in the second position and the second handle is in any position, the latch being in the unlocked position also when the second handle is in the fourth position and the first handle is in any position,
the locked position of the latch preventing the at least one door from pivoting with respect to the vehicle when the door is in a closed position,
the unlocked position of the latch allowing the at least one door to pivot with respect to the vehicle,
the first handle being operatively connected to the second handle such that rotation of one of the first handle and the second handle causes an other one of the first handle and the second handle to rotate;
the first handle being in the first position when the second handle is in the third position,
the first handle being in the second position when the second handle is in the fourth position,
the first handle and the second handle having a fixed relative orientation to each other such that rotation of the one of the first and second handles causes an equal rotation of the other one of the first and second handles.

15. The vehicle of claim 14, wherein:
the latch is disposed in a rear portion of the at least one door;
the at least one door further comprises at least one hinge connected to a front portion of the at least one door; and
the at least one hinge pivotably connects the at least one door to the vehicle.

16. The vehicle of claim 14, wherein:
the at least one door further comprises a biasing element operatively connected to at least one of the first handle and the second handle; and
the biasing element biases the first handle toward the first position and the second handle toward the third position.

17. The vehicle of claim 14, wherein:
the at least one door further comprises a shaft connected the door body; and
the first handle and the second handle are rotatably disposed on the shaft.

18. The vehicle of claim 14, further comprising a striker connected to the frame, the latch being fastened to the striker when the door is in the closed position and the latch is in the locked position.

19. The vehicle of claim 14, wherein the rotation axis is oriented parallel to an outer surface of the at least one door.

* * * * *